US010152916B2

(12) United States Patent
Wang et al.

(10) Patent No.: US 10,152,916 B2
(45) Date of Patent: Dec. 11, 2018

(54) AMOLED PIXEL DRIVING CIRCUIT, METHOD AND DISPLAY DEVICE

(71) Applicant: BOE TECHNOLOGY GROUP CO., LTD., Beijing (CN)

(72) Inventors: Ying Wang, Beijing (CN); Ying Liu, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 44 days.

(21) Appl. No.: 14/433,598

(22) PCT Filed: Aug. 27, 2014

(86) PCT No.: PCT/CN2014/085277
§ 371 (c)(1),
(2) Date: Apr. 3, 2015

(87) PCT Pub. No.: WO2015/158091
PCT Pub. Date: Oct. 22, 2015

(65) Prior Publication Data

US 2016/0267837 A1 Sep. 15, 2016

(30) Foreign Application Priority Data

Apr. 18, 2014 (CN) ..... 2014 1 0158960

(51) Int. Cl.
*G09G 3/20* (2006.01)
*G09G 3/3216* (2016.01)
(Continued)

(52) U.S. Cl.
CPC ..... *G09G 3/3216* (2013.01); *G09G 3/2003* (2013.01); *G09G 3/3225* (2013.01);
(Continued)

(58) Field of Classification Search
CPC ..... G09G 3/3233; G09G 3/3283; G09G 2300/0819; G09G 3/3241;
(Continued)

(56) References Cited

U.S. PATENT DOCUMENTS 6,486,606 B1 11/2002 Ting
9,437,139 B2 9/2016 Song et al.
(Continued)

FOREIGN PATENT DOCUMENTS

CN 101097680 A 1/2008
CN 201549184 U 8/2010
(Continued)

OTHER PUBLICATIONS

International Search Report and Written Opinion dated Aug. 27, 2014 regarding PCT/CN2014/085277.
(Continued)

*Primary Examiner* — Robert Michaud
(74) *Attorney, Agent, or Firm* — Harness, Dickey & Pierce, P.L.C.

(57) ABSTRACT

The present disclosure provides an AMOLED pixel driving circuit, method and a display device. The AMOLED pixel driving circuit is for driving an organic light-emitting diode (OLED) and includes: a charge storage unit configured to be charged in a data writing stage and be discharged in a pixel lighting stage to light up the OLED; a data writing unit configured to write a data current in the data writing stage; a light-emitting control unit configured to control to enable a connection between the charge storage unit and the OLED in the pixel lighting stage. The AMOLED pixel driving circuit further includes a current amplification unit configured to, in the data writing stage, amplify the data current and charge the charge storage unit with the amplified data current.

13 Claims, 3 Drawing Sheets

(51) Int. Cl.
*G09G 3/3225* (2016.01)
*G09G 3/3275* (2016.01)
*G09G 3/3283* (2016.01)

(52) U.S. Cl.
CPC ..... *G09G 3/3275* (2013.01); *G09G 3/3283* (2013.01); *G09G 2300/0809* (2013.01)

(58) Field of Classification Search
CPC .... G09G 2320/0233; G09G 3/04; G09G 3/10; G09G 3/30; G09G 3/3216; G09G 3/2003; G09G 3/3225; G09G 3/3275; G09G 2300/3809
See application file for complete search history.

(56) References Cited

U.S. PATENT DOCUMENTS

| | | | | |
|---|---|---|---|---|
| 2005/0225251 | A1 | 10/2005 | Hsueh | |
| 2005/0242744 | A1* | 11/2005 | Tseng | G09G 3/3241 315/169.3 |
| 2006/0181496 | A1 | 8/2006 | Yu et al. | |
| 2007/0046588 | A1* | 3/2007 | Tsai | G09G 3/3241 345/76 |
| 2007/0091030 | A1* | 4/2007 | Drevillon | G09G 3/3233 345/76 |
| 2008/0001857 | A1* | 1/2008 | Yoo | G09G 3/3233 345/76 |
| 2009/0135165 | A1 | 5/2009 | Fukuzako et al. | |
| 2013/0328848 | A1 | 12/2013 | Chao et al. | |
| 2015/0302802 | A1 | 10/2015 | Song et al. | |

FOREIGN PATENT DOCUMENTS

| | | | |
|---|---|---|---|
| CN | 103354081 | A | 10/2013 |
| CN | 203311819 | U | 11/2013 |
| CN | 103956138 | A | 7/2014 |
| CN | 203773914 | U | 8/2014 |
| JP | 2009188773 | A | 8/2009 |
| JP | 2010028425 | A | 2/2010 |

OTHER PUBLICATIONS

First Chinese Office Action dated Dec. 15, 2014 regarding Chinese Application No. 201410158960.0. Translation provided by Dragon Intellectual Property Law Firm.
Written Opinion of the International Searching Authority for international application No. PCT/CN2014/085277.
European Search Report regarding Application No. 14859296.7-1914/3133586, dated Aug. 4, 2017. Translation provided by Dragon Intellectual Property Law Firm.
Extended European Search Report, Munich, regarding Application No. 14859296.7 dated Nov. 13, 2017.
Chinese Search Report regarding Application No. 201410158960.0 dated Oct. 21, 2014. English translation provided by Dragon Intellectual Property Law Firm.

* cited by examiner

AMOLED PIXEL DRIVING CIRCUIT, METHOD AND DISPLAY DEVICE

CROSS-REFERENCE TO RELATED APPLICATIONS

The present application is the U.S. national phase of PCT Application No. PCT/CN2014/085277 filed on Aug. 27, 2014, which claims a priority of the Chinese patent application No. 201410158960.0 filed on Apr. 18, 2014, which are incorporated herein by reference in their entirety.

TECHNICAL FIELD

The present disclosure relates to the field of display technology, in particular to an active matrix/organic light Emitting diode (AMOLED) pixel driving circuit, method and a display device.

BACKGROUND

A current-mode AMOLED pixel driving circuit directly uses a current signal to drive a pixel circuit. Brightness of an OLED is directly proportional to a value of the driving current, and a multi-level gray scale display can be realized.

As shown in FIG. 1, an existing current-mode AMOLED pixel driving circuit includes a driving transistor TP1, a data writing transistor TP2 and a storage unit; the TP1 and TP2 are PMOS transistors. The storage unit includes a storage capacitor C and a resistor R which are connected in parallel with each other. In a data writing stage, a data-writing control signal Gate received in a gate electrode of the TP2 is of low level, the TP2 turns on, Idata passes through the TP2 and charges the storage capacitor C. In a pixel lighting stage, a light-emitting control signal EM received in a gate electrode of the TP1 is of low level, the TP1 turns on, the storage capacitor C is discharged to light up the OLED. A cathode of the OLED is coupled with a low-level output terminal ELVSS of a driving power supply. The existing current-mode AMOLED pixel driving circuit requires a driving current of a certain value to drive the OLED, and since a charging amount of the storage capacitor in the data writing stage is fixed and the charging amount cannot be adjusted in this stage, thus the gray scale level cannot be adjusted.

SUMMARY

A main object of the present disclosure is to provide an AMOLED pixel driving circuit, method and a display device, which can drive an OLED with a very small data current and can adjust a gray scale level by adjusting a value of a current flowing through the OLED in a pixel lighting stage.

In order to achieve the above object, the present disclosure provides a pixel driving circuit for driving an organic light emitting diode (OLED), including: a charge storage unit configured to be charged in a data writing stage and be discharged in a pixel lighting stage to light up the OLED; a data writing unit configured to write a data current in the data writing stage; a light-emitting control unit configured to control to enable a connection between the charge storage unit and the OLED in the pixel lighting stage; and a current amplification unit configured to, in the data writing stage, amplify the data current and charge the charge storage unit with the amplified data current.

During implementation, the current amplification unit amplifies the data current during an entire period of time of the data writing stage and charge the charge storage unit with the amplified data current.

During implementation, the current amplification unit charges the charge storage unit with the amplified data current during a part of the period of time of the data writing stage according to requirements of gray scale level.

During implementation, the data writing stage includes a current amplification stage and a direct charging stage; in the current amplification stage, the current amplification unit amplifies the data current and the data writing unit uses the amplified data current to charge the charge storage unit; in the direct charging stage, the data writing unit is further configured to directly charge the charge storage unit with the data current.

During implementation, a connection point between the data writing unit and the charge storage unit is a writing node;

the current amplification unit includes a current amplification control module and a proportional current mirror;

the current amplification control module is configured to enable a connection between the writing node and a current input terminal of the proportional current mirror during an entire or a part of the period of time of the data writing stage;

a current output terminal of the proportional current mirror is coupled with the writing node; and the proportional current mirror is configured to amplify the data current.

During implementation, the data writing unit includes a data writing transistor, a gate electrode of the data writing transistor receives a data-writing control signal, a first electrode of the data writing transistor receives the data current and a second electrode of the data writing transistor is coupled with the writing node.

The current amplification control module includes:

an amplification control transistor, a base electrode of the amplification control transistor is coupled with the writing node and a first electrode of the amplification control transistor receives a current amplification control signal;

a writing control transistor, a gate electrode of the writing control transistor receives the data-writing control signal, a first electrode of the writing control transistor is coupled with the current input terminal of the proportional current mirror, and a second electrode of the writing control transistor is coupled with a second electrode of the amplification control transistor.

During implementation, a timing sequence of the current amplification control signal is same as or different from a timing sequence of the data-writing control signal.

During implementation, the data writing transistor and the writing control transistor are PMOS transistors.

During implementation, one or both of the data writing transistor and the writing control transistor are NMOS transistors.

During implementation, the proportional current mirror includes an input branch and an output branch;

the input branch includes:

a first PMOS transistor, a first electrode of the first PMOS transistor is coupled with a high-level output terminal of a driving power supply: and a first NMOS transistor, a gate electrode of the first NMOS transistor is coupled with a first electrode of the first NMOS transistor, the first electrode of the first NMOS transistor is coupled with a low-level output terminal of the driving power supply, and a second electrode of the first NMOS transistor is coupled with a second electrode of the first PMOS transistor;

the second electrode of the first NMOS transistor is the current input terminal of the proportional current mirror;

the output branch includes:

a second PMOS transistor, a gate electrode of the second PMOS transistor is coupled with a gate electrode of the first PMOS transistor, a first electrode of the second PMOS transistor is coupled with the high-level output terminal of the driving power supply, and a second electrode of the second PMOS transistor is coupled with the gate electrode of the second PMOS transistor; and a second NMOS transistor, a gate electrode of the second NMOS transistor is coupled with the gate electrode of the first NMOS transistor, a first electrode of the second NMOS transistor is the current output terminal, and a second electrode of the second NMOS transistor is coupled with the second electrode of the second PMOS transistor.

During implementation, a width to length ratio of the second PMOS transistor is equal to a width to length ratio of the second NMOS transistor; a width to length ratio of the first PMOS transistor is equal to a width to length ratio of the first NMOS transistor;

the width to length ratio of the second PMOS transistor is K times of the width to length ratio of the first PMOS transistor, K is greater than 1.

During implementation, the light-emitting control unit includes a driving transistor; the driving transistor has a gate electrode for receiving a light-emitting control signal, a first electrode coupled with the writing node and a second electrode coupled with an anode of the OLED; a cathode of the OLED is coupled with the low-level output terminal of the driving power supply.

During implementation, the charge storage unit includes a storage capacitor and a resistor which are connected in parallel with each other; the storage capacitor has one terminal coupled with the writing node and the other terminal coupled with the low-level output terminal of the driving power supply.

The present disclosure further provides a pixel driving method including:

in a data writing stage, writing by a data writing unit, a data current;

in the data writing stage, amplifying by a current amplification unit, the data current, and charging a charge storage unit with the amplified data current;

in a pixel lighting stage, controlling by a light-emitting control unit, to enable a connection between the charge storage unit and an OLED, and discharging the charge storage unit to light up the OLED.

During implementation, the data writing stage includes a current amplification stage and a direct charging stage;

in the current amplification stage, the current amplification unit amplifies the data current and the data writing unit uses the amplified data current to charge the charge storage unit;

in the direct charging stage, the data writing unit directly charges the charge storage unit with the data current.

The present disclosure further provides a display device including an OLED and the above pixel driving circuit; the pixel driving circuit is configured to drive the OLED.

As compared with the related art, the pixel driving circuit, method and the display device of the present disclosure use the current amplification unit in the data writing stage to amplify the date current written by the data writing unit, charges the charge storage unit with the amplified data current, and discharges the charge storage unit in the pixel lighting stage to light up the OLED, so that the OLED may be driven by a very small data current; and a value of a current flowing through the OLED in the pixel lighting stage may be adjusted by controlling a period of time during which the current amplification unit amplifies the data current, so that a gray scale level may be adjusted.

DETAILED DESCRIPTION

The technical solutions of embodiments of the present disclosure will be described hereinafter in a clear and complete manner in conjunction with drawings of the embodiments of the present disclosure. Obviously, the described embodiments are merely some rather than all of, the embodiments of the present disclosure. Based on these embodiments of the present disclosure, a person skilled in the art may obtain other embodiments without creative work, which also fall within the scope of the present disclosure.

Transistors adopted in all embodiments of the present disclosure may be thin film transistors, field effect transistors, or other devices having same characteristics. In embodiments of the present disclosure, in order to distinguish two electrodes of a transistor in addition to a gate electrode, one electrode of the two is referred to as "source electrode" and the other electrode is referred to as "drain electrode".

Figure 1:
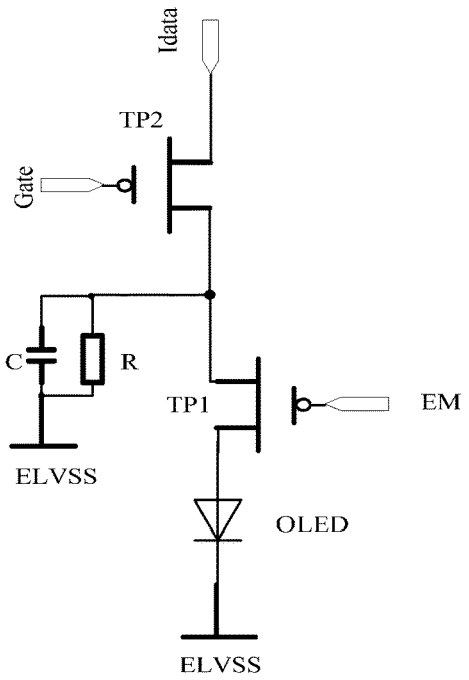
FIG. 1 is a circuit diagram of an existing current-mode AMOLED pixel driving circuit.
Figure 2:
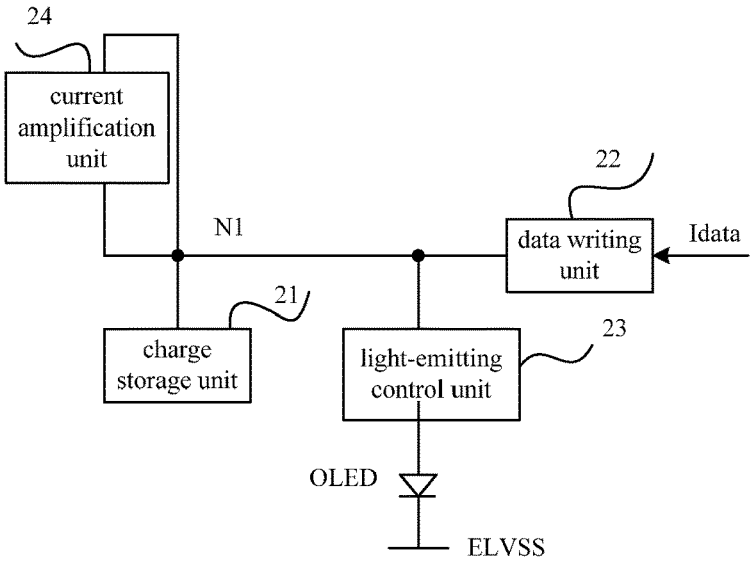
FIG. 2 is a block diagram of an AMOLED pixel driving circuit according to one embodiment of the present disclosure.

As shown in FIG. 2, an AMOLED pixel driving circuit according to one embodiment of the present disclosure is configured to drive an organic light-emitting diode (OLED) and includes:

a charge storage unit 21 configured to be charged in a data writing stage and discharged in a pixel lighting stage to light up the OLED;

a data writing unit 22 configured to write a data current Idata in the data writing stage;

a light-emitting control unit 23 configured to control to enable a connection between the charge storage unit 21 and the OLED in the pixel lighting stage; and a current amplification unit 24 configured to, in the data writing stage, amplify the data current Idata and charge the charge storage unit 21 with the amplified data current Idata.

The AMOLED pixel driving circuit according to one embodiment of the present disclosure is a current-mode AMOLED pixel driving circuit, uses the current amplification unit to amplify the date current written by the data writing unit in the data writing stage, charges the charge storage unit with the amplified data current, and discharges the charge storage unit in the pixel lighting stage to light up the OLED, so that the OLED may be driven by a very small data current. A value of a current flowing through the OLED in the pixel lighting stage may be adjusted by controlling a period of time during which the current amplification unit amplifies the data current, so that a gray scale level may be adjusted.

In the above embodiment, the current amplification unit may amplify the data current during an entire period of time of the data writing stage and charge the charge storage unit with the amplified data current. According to requirements of gray scale level, the current amplification unit may charge the charge storage unit with the amplified data current during a part of the period of time of the data writing stage.

Specifically, when the current amplification unit amplifies the data current during a part of the period of time of the data writing stage, the data writing stage may be divided into a current amplification stage and a direct charging stage.

The current amplification unit amplifies the data current in the current amplification stage and the data writing unit uses the amplified data current to charge the charge storage unit. The data writing unit is further configured to directly charge the charge storage unit with the data current in the direct charging stage.

Figure 3:
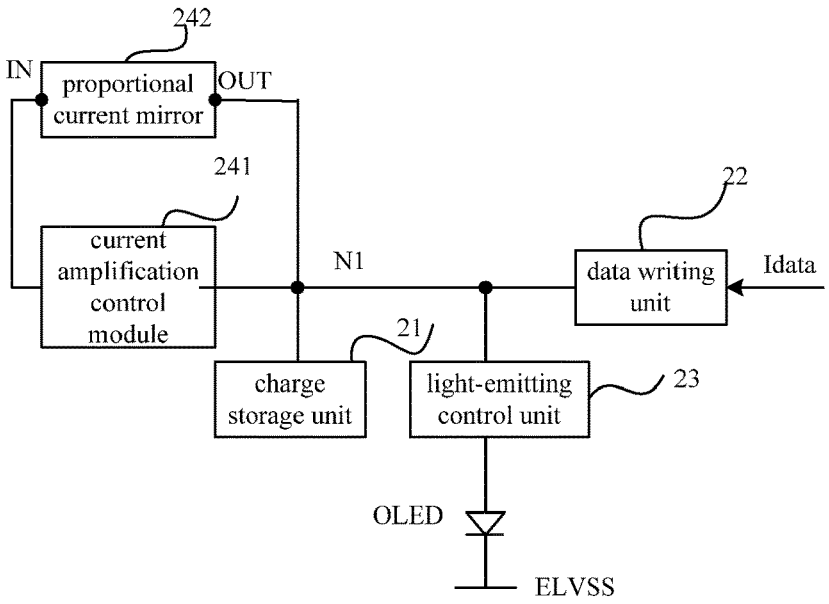
FIG. 3 is a block diagram of an AMOLED pixel driving circuit according to another embodiment of the present disclosure.

Specifically, as shown in FIG. 3, a connection point between the data writing unit 22 and the charge storage unit 21 is a writing node N1.

The current amplification unit includes a current amplification control module 241 and a proportional current mirror 242.

The current amplification control module 241 is configured to enable a connection between the writing node N1 and a current input terminal IN of the proportional current mirror 242 during the entire or part of the period of time of the data writing stage.

A current output terminal of the proportional current mirror 242 is coupled with the writing node N1.

The proportional current mirror 242 is configured to amplify the data current Idata.

In the embodiment shown in FIG. 3, the proportional current mirror is adopted to amplify the data current Idata. Since the proportional current mirror may amplify current and is not affected by process and temperature, thus stability of a display screen is further ensured.

Figure 4:
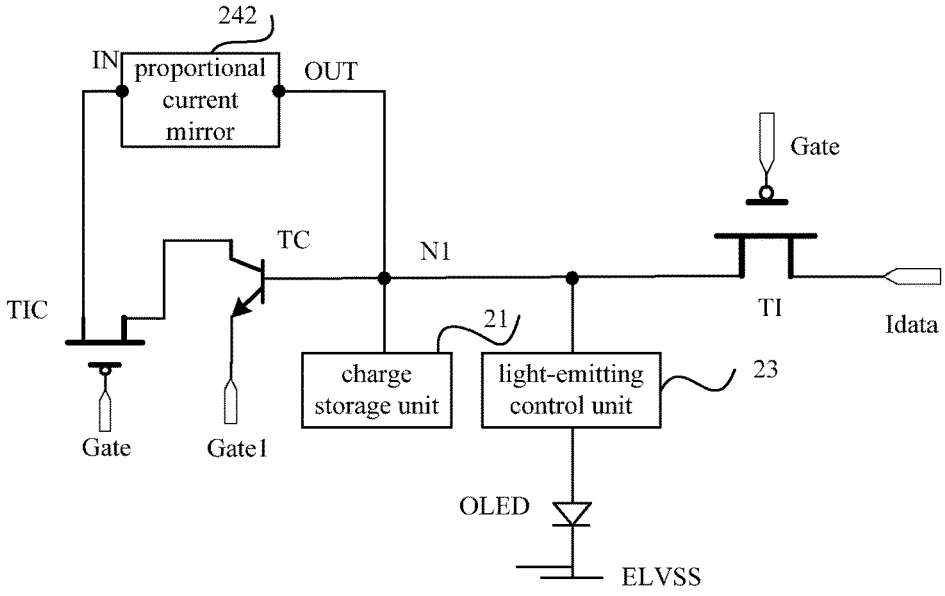
FIG. 4 is a block diagram of an AMOLED pixel driving circuit according to still another embodiment of the present disclosure.

Specifically, as shown in FIG. 4, the data writing unit includes a data writing transistor TI, a gate electrode thereof receives a data-writing control signal Gate, a first electrode thereof receives the data current Idata and a second electrode thereof is connected with the writing node N1.

The current amplification control module 241 includes:

an amplification control transistor TC, a base electrode of TC is coupled with the writing node N1 and a first electrode of TC receives a current amplification control signal Gate1:

a writing control transistor TIC, a gate electrode of TIC receives the data-writing control signal Gate, a first electrode of TIC is coupled with the current input terminal IN of the proportional current mirror 242, and a second electrode of TIC is coupled with a second electrode of the amplification control triode TC.

In the embodiment shown in FIG. 4, the TI and TIC are p-channel metal oxide semiconductor field effect transistors (PMOS transistors). In actual operation, one or both of the TI and TIC may employ an NMOS transistor, which accordingly requires a simple adjustment of pin connections and control signals.

In the embodiment shown in FIG. 4, a timing sequence of Gate may be same as a timing sequence of Gate; then, the current amplification control module enables the connection between the writing node N1 and the current input terminal IN of the proportional current mirror 242 during the entire period of time of the data writing stage.

The timing sequence of Gate1 may also be different from the timing sequence of Gate, that is, when Gate controls the TC and TIC to turn on, Gate1 controls the TC to turn on during a part of the period of time, and Gate1 controls the TC to turn off in the rest of the period of time, the current amplification control module enable the connection between the writing node N1 and the current input terminal IN of the proportional current mirror 242 during the part of the period of time of the data writing stage.

Figure 5:
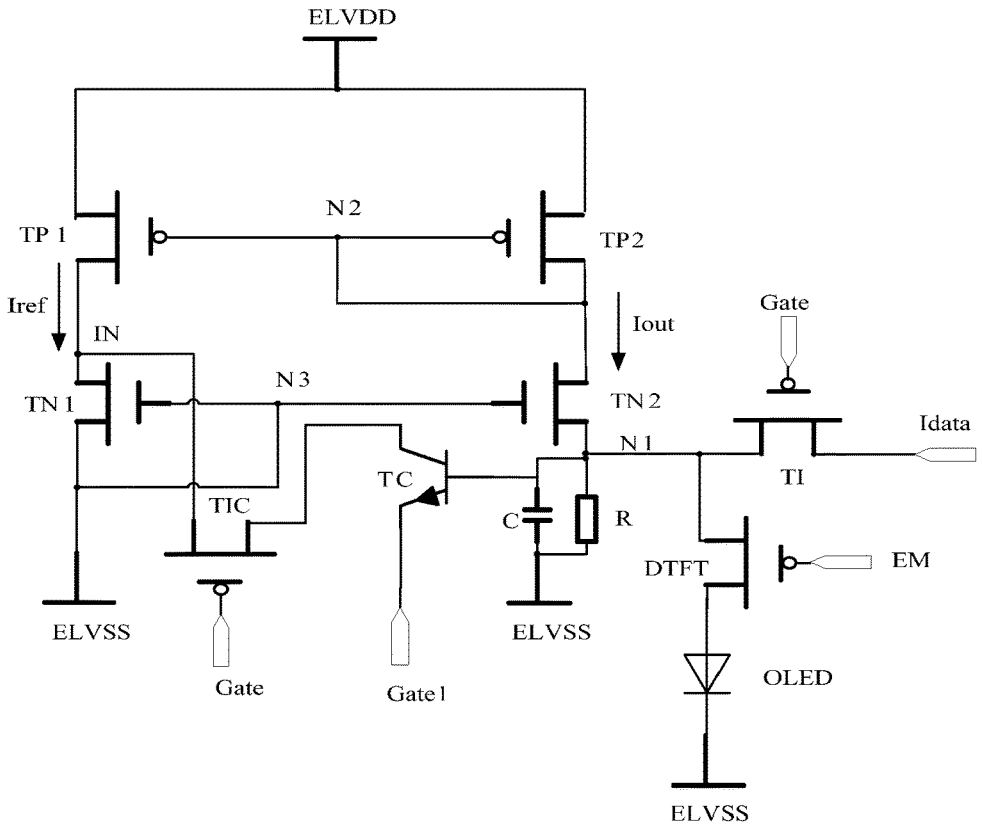
FIG. 5 is a circuit diagram of an AMOLED pixel driving circuit according to yet another embodiment of the present disclosure.

Specifically, as shown in FIG. 5, the proportional current mirror includes an input branch and an output branch.

The input branch includes:

a first PMOS transistor TP1, a first electrode of TP1 is coupled with a high-level output terminal ELVDD of the driving power supply; and a first NMOS transistor TN1, a gate electrode of TN1 is coupled with a first electrode of the first NMOS transistor TN1, the first electrode of TN1 is coupled with the low-level output terminal ELVSS of the driving power supply, and a second electrode of TN1 is coupled with a second electrode of the first PMOS transistor TP1;

the second electrode of the first NMOS transistor TN1 is the current input terminal IN of the proportional current mirror.

The output branch includes:

a second PMOS transistor TP2, a gate electrode of TP2 is coupled with the gate electrode of the first PMOS transistor TP1, a first electrode of TP2 is coupled with the high-level output terminal ELVDD of the driving power supply, and a second electrode of TP2 is coupled with the gate electrode of the second PMOS transistor TP2; and a second NMOS transistor TN2, a gate electrode of TN2 is coupled with the gate electrode of the first NMOS transistor TN1, a first electrode of TN2 is the current output terminal of the proportional current mirror, and a second electrode of TN2 is coupled with the second electrode of the second PMOS transistor TP2.

The charge storage unit includes a storage capacitor C and a resistor R which are connected in parallel with each other.

One terminal of the storage capacitor C is coupled with the writing node N1, and the other terminal of the storage capacitor C is coupled with the low-level output terminal ELVSS of the driving power supply.

The light-emitting control unit includes a driving transistor DTFT, a gate electrode of DTFT receives the light-emitting control signal EM, a first electrode of DTFT is coupled with the writing node N1, and a second electrode of DTFT is coupled with an anode of the OLED.

The cathode of the OLED is coupled with the low-level output terminal ELVSS of the driving power supply.

In the embodiment shown in FIG. 5, the DTFT is a PMOS transistor; in actual operation, the DTFT may also employ an NMOS transistor. A point N2 is a node coupled with the gate electrode of the TP1, and a point N3 is a node coupled with the gate electrode of the TN1.

In the embodiment shown in FIG. 5, a width to length ratio of the second PMOS transistor TP2 is equal to a width to length ratio of the second NMOS transistor TN2; a width to length ratio of the first PMOS transistor TP1 is equal to a width to length ratio of the first NMOS transistor TN1.

The width to length ratio of the second PMOS transistor TP2 is K times of the width to length ratio of the first PMOS transistor TP1, K is greater than 1, then Iout=KIref, where Iout represents an output current of the proportional current mirror, Iref represents an input current of the proportional current mirror.

Figure 6:
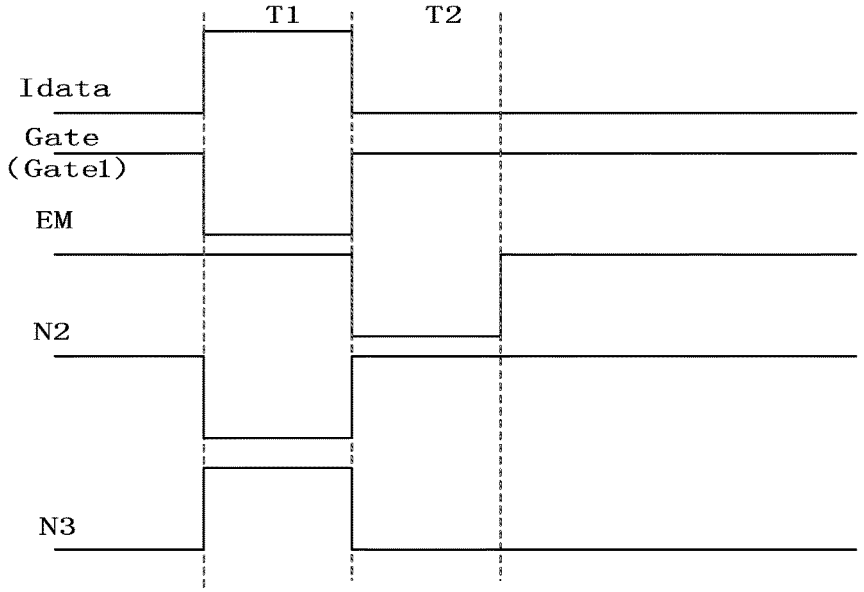
FIG. 6 is a diagram showing a timing sequence of working signals of the AMOLED pixel driving circuit according to the embodiment shown in FIG. 5.

As shown in FIG. 6, the timing sequence of the Gate is same as the timing sequence of the Gate1. That is, in the data writing stage, the current amplification unit amplifies the data current and uses the amplified data current to charge the charge storage unit. When the AMOLED pixel driving circuit shown in FIG. 5 works, in the data writing stage T1, Gate and Gate1 are low-level signals, EM is a high-level signal, TI, TIC and TC turn on, and DTFT turns off; Idata is first input in the base electrode of the TC through the TI; the TC performs a first amplification of the Idata, the input current Iref of the proportional current mirror is N×Idata, the output current Iout of the proportional current mirror is K×N×Idata, Iout is for charging the storage capacitor C, where N is an amplification factor of the TC.

In the data writing stage T1, a suitable bias voltage is applied at the N2 point and the N3 point, so that all of TP1, TP2, TN1 and TN work in the saturation region, at this time, Iref and Iout are almost irrelevant to ELVDD, which may avoid flashing caused by instable current resulting from voltage fluctuation of the power supply, and ensure the stability of a display screen.

In the pixel lighting stage T2, Gate and Gate1 are high-level signals, EM is a low-level signal, TI, TIC and TC turn off, DTFT turns on, and the storage capacitor is discharged to light up the OLED.

In actual operation, a period of time during which the TC turns on may be controlled by adjusting the timing sequence of Gate1, and then Iout is controlled, and the gray scale level may be adjusted.

In the AMOLED pixel driving circuit of the embodiment shown in FIG. 5, the number of transistors is large, the AMOLED pixel driving circuit is more suitable for use in top-emitting; but since the output current of the proportional current mirror is only related to a width to length ratio of the MOS transistor, thus, the MOS transistor may be made in small size and will not occupy much space, and may be applied in the OLED-on-silicon (silicon-based organic light emitting diode) micro display technology based on monocrystalline silicon substrates.

The present disclosure further provides an AMOLED pixel driving method applied in the above AMOLED pixel driving circuit, includes:

in a data writing stage, writing, by a data writing unit, a data current;

in the data writing stage, amplifying, by a current amplification unit, the data current, and charging a charge storage unit with the amplified data current;

in a pixel lighting stage, controlling, by an light-emitting control unit, to enable a connection between the charge storage unit and an OLED, and discharging the charge storage unit to light up the OLED.

Specifically, when the current amplification unit amplifies the data current during a part of the period of time of the data writing stage, the data writing stage may include a current amplification stage and a direct charging stage.

In the current amplification stage, the current amplification unit amplifies the data current and the data writing unit uses the amplified data current to charge the charge storage unit.

In the direct charging stage, the data writing unit directly charges the charge storage unit with the data current.

The present disclosure further provides a display device, which includes an OLED and the above AMOLED pixel driving circuit configured to drive the OLED.

The above are merely optional embodiments of the present disclosure. It should be appreciated that, a person skilled in the art may make further improvements and modifications without departing from the principle of the present disclosure, and these improvements and modifications shall also fall within the scope of the present disclosure.

What is claimed is:

1. A pixel driving circuit for driving an organic light-emitting diode (OLED), the pixel driving circuit comprising:

a charge storage circuit configured to be charged in a data writing stage and be discharged in a pixel lighting stage to light up the OLED;

a data writing circuit configured to write a data current in the data writing stage;

a light-emitting control circuit configured to control and enable a connection between the charge storage circuit and the OLED in the pixel lighting stage; and a current amplification circuit configured to, in the data writing stage, amplify the data current and charge the charge storage circuit with the amplified data current, wherein the current amplification circuit amplifies the data current during an entire period of time of the data writing stage and charges the charge storage circuit with the amplified data current, a connection point between the data writing circuit and the charge storage circuit is a writing node, the current amplification circuit comprises a current amplification control circuit and a proportional current mirror, the current amplification control circuit is configured to enable a connection between the writing node and a current input terminal of the proportional current mirror during an entire or a part of the period of time of the data writing stage, a current output terminal of the proportional current mirror is coupled with the writing node-and, the proportional current mirror is configured to amplify the data current, the data writing circuit comprises a data writing transistor, a gate electrode of the data writing transistor receives a data-writing control signal, a first electrode of the data writing transistor receives the data current, a second electrode of the data writing transistor is coupled with the writing node;

the current amplification control circuit comprises an amplification control bipolar junction transistor, wherein a base electrode of the amplification control bipolar junction transistor is coupled with the writing node, and wherein an emitter electrode of the amplification control bipolar junction transistor receives a current amplification control signal[, and a writing control transistor, wherein a gate electrode of the writing control transistor receives the data-writing control signal, wherein a first electrode of the writing control transistor is coupled with the current input terminal of the proportional current mirror, and wherein a second electrode of the writing control transistor is coupled with a collector electrode of the amplification control amplification control transistor, the proportional current mirror comprises a first PMOS-transistor, a first NMOS transistor, a second PMOS transistor, and a second NMOS transistor, an input branch and an output branch, the input branch comprises the first PMOS transistor, wherein a first electrode of the first PMOS transistor is directly connected with a high-level output terminal of a driving power supply, and the first NMOS transistor, wherein a gate electrode of the first NMOS transistor is directly connected with a first electrode of the first NMOS transistor, wherein the first electrode of the first NMOS transistor is directly connected with a low-level output terminal of the driving power supply, and wherein a second electrode of the first NMOS transistor is directly connected with a second electrode of the first PMOS transistor, the second electrode of the first NMOS transistor is the current input terminal of the proportional current mirror, and the output branch comprises the second PMOS transistor, wherein a gate electrode of the second PMOS transistor is directly connected with a gate electrode of the first PMOS transistor, wherein a first electrode of the second PMOS transistor is directly connected with the high-level output terminal of the driving power supply, and wherein a second electrode of the second PMOS transistor is directly connected with the gate electrode of the second PMOS transistor, and the second NMOS transistor, wherein a gate electrode of the second NMOS transistor is directly connected with the gate electrode of the first NMOS transistor, wherein a first electrode of the second NMOS transistor is the current output terminal, and wherein a second electrode of the second NMOS transistor is directly connected with the second electrode of the second PMOS transistor.

2. The pixel driving circuit according to claim 1, wherein the current amplification circuit charges the charge storage circuit with the amplified data current during a part of the period of time of the data writing stage according to requirements of gray scale level.

3. The pixel driving circuit according to claim 2, wherein:

the data writing stage comprises a current amplification stage and a direct charging stage;

in the current amplification stage, the current amplification circuit amplifies the data current and the data writing circuit using the amplified data current to charge the charge storage circuit; and in the direct charging stage, the data writing circuit is further configured to directly charge the charge storage circuit with the data current.

4. The pixel driving circuit according to claim 1, wherein a timing sequence of the current amplification control signal is same as a timing sequence of the data-writing control signal.

5. The pixel driving circuit according to claim 1, wherein the data writing transistor and the writing control transistor are PMOS transistors.

6. The pixel driving circuit according to claim 1, wherein one or both of the data writing transistor and the writing control transistor are NMOS transistors.

7. The pixel driving circuit according to claim 1, wherein:

a width to length ratio of the second PMOS transistor is equal to a width to length ratio of the second NMOS transistor;

a width to length ratio of the first PMOS transistor is equal to a width to length ratio of the first NMOS transistor; and the width to length ratio of the second PMOS transistor is K times the width to length ratio of the first PMOS transistor, where K is greater than 1.

8. The pixel driving circuit according to claim 1, wherein:

the light-emitting control circuit comprises a driving transistor;

the driving transistor comprises a gate electrode for receiving a light-emitting control signal, a first electrode coupled with a writing node, and a second electrode coupled with an anode of the OLED; and a cathode of the OLED is coupled with a low-level output terminal of a driving power supply.

9. The pixel driving circuit according to claim 1, wherein:

the charge storage circuit comprises a storage capacitor and a resistor which are connected in parallel with each other; and the storage capacitor has one terminal coupled with a writing node and another terminal coupled with a low-level output terminal of a driving power supply.

10. A display device comprising:

an OLED; and the pixel driving circuit according to claim 1, wherein the pixel driving circuit is configured to drive the OLED.

11. The pixel driving circuit according to claim 1, wherein a timing sequence of the current amplification control signal is different than a timing sequence of the data-writing control signal.

12. A pixel driving method comprising:

in a data writing stage, writing, by a data writing circuit, a data current;

in the data writing stage, amplifying, by a current amplification circuit, the data current, and charging a charge storage circuit with the amplified data current; and in a pixel lighting stage, controlling and enabling, by a light-emitting control circuit, a connection between the charge storage circuit and an OLED, and discharging the charge storage circuit to light up the OLED, wherein the current amplification circuit amplifies the data current during an entire period of time of the data writing stage and charges the charge storage circuit with the amplified data current a connection point between the data writing circuit and the charge storage circuit is a writing node, the current amplification circuit comprises a current amplification control circuit and a proportional current mirror, the current amplification control circuit is configured to enable a connection between the writing node and a current input terminal of the proportional current mirror during an entire or a part of the period of time of the data writing stage, a current output terminal of the proportional current mirror is coupled with the writing node and, the proportional current mirror is configured to amplify the data current the data writing circuit comprises a data writing transistor, a gate electrode of the data writing transistor receives a data-writing control signal a first electrode of the data writing transistor receives the data current, a second electrode of the data writing transistor is coupled with the writing node; the current amplification control circuit comprises an amplification control bipolar junction transistor, wherein a base electrode of the amplification control bipolar junction transistor is coupled with the writing node, and wherein an emitter electrode of the amplification control bipolar junction transistor receives a current amplification control signal and a writing control transistor, wherein a gate electrode of the writing control transistor receives the data-writing control signal, wherein a first electrode of the writing control transistor is coupled with the current input terminal of the proportional current mirror, and wherein a second electrode of the writing control transistor is coupled with a collector electrode of the amplification control amplification control transistor the proportional current mirror comprises a first PMOS-transistor, a first NMOS transistor, a second PMOS transistor, and a second NMOS transistor, an input branch and an output branch, the input branch comprises the first PMOS transistor, wherein a first electrode of the first PMOS transistor is directly connected with a high-level output terminal of a driving power supply, and the first NMOS transistor, wherein a gate electrode of the first NMOS transistor is directly connected with a first electrode of the first NMOS transistor, wherein the first electrode of the first NMOS transistor is directly connected with a low-level output terminal of the driving power supply, and wherein a second electrode of the first NMOS transistor is directly connected with a second electrode of the first PMOS transistor, the second electrode of the first NMOS transistor is the current input terminal of the proportional current mirror, and the output branch comprises the second PMOS transistor, wherein a gate electrode of the second PMOS transistor is directly connected with a gate electrode of the first PMOS transistor, wherein a first electrode of the second PMOS transistor is directly connected with the high-level output terminal of the driving power supply, and wherein a second electrode of the second PMOS transistor is directly connected with the gate electrode of the second PMOS transistor, and the second NMOS transistor, wherein a gate electrode of the second NMOS transistor is directly connected with the gate electrode of the first NMOS transistor, wherein a first electrode of the second NMOS transistor is the current output terminal, and wherein a second electrode of the second NMOS transistor is directly connected with the second electrode of the second PMOS transistor.

13. The pixel driving method according to claim 12, wherein:

the data writing stage comprises a current amplification stage and a direct charging stage;

in the current amplification stage, the current amplification circuit amplifies the data current, and the data writing circuit uses the amplified data current to charge the charge storage circuit; and in the direct charging stage, the data writing circuit directly charges the charge storage circuit with the data current.

* * * * *